US007409828B2

(12) United States Patent
Bertleff

(10) Patent No.: US 7,409,828 B2
(45) Date of Patent: Aug. 12, 2008

(54) CONTROL DEVICE

(75) Inventor: Wolfgang Bertleff, Erlangen (DE)

(73) Assignee: Lukas Hydraulik GmbH, Erlangen (DE)

( * ) Notice: Subject to any disclaimer, the term of this patent is extended or adjusted under 35 U.S.C. 154(b) by 224 days.

(21) Appl. No.: 11/251,098

(22) Filed: Oct. 14, 2005

(65) Prior Publication Data

US 2006/0081120 A1 Apr. 20, 2006

(30) Foreign Application Priority Data

Oct. 20, 2004 (DE) ..... 10 2004 051 213

(51) Int. Cl.
*F15B 20/00* (2006.01)
*E02F 3/36* (2006.01)

(52) U.S. Cl. ..... 60/484; 91/445

(58) Field of Classification Search ..... 60/484; 91/424, 445, 521

See application file for complete search history.

(56) References Cited

U.S. PATENT DOCUMENTS 5,152,312 A * 10/1992 Kogel ..... 60/484
5,497,805 A * 3/1996 Sunamura et al. ..... 91/527
5,727,442 A * 3/1998 Wimmer ..... 91/42

FOREIGN PATENT DOCUMENTS

| | | | |
|---|---|---|---|
| DE | 2019052 | | 4/1970 |
| DE | 1347023 | | 4/1971 |
| DE | 2263772 | A * | 7/1974 |
| DE | 694 25 539 | T2 | 4/2001 |
| EP | 0 649 988 | B1 | 8/2000 |
| GB | 2340486 | A * | 2/2000 |

OTHER PUBLICATIONS

Patent Office of the People's Republic of China, Notification of Second Office Action, Dec. 14, 2007, China.
Jihai, Jiang, Jinchun, Song and Changshi, Gao, "Hydraulics and Pneumatics", pp. 138-141; Edition 1, Jan. 2002.

* cited by examiner

*Primary Examiner*—Thomas E Lazo
(74) *Attorney, Agent, or Firm*—Vedder Price P.C.

(57) ABSTRACT

Control device 1 having a changeover valve 5, a pump 4 delivering operating medium, in particular a motor-operated pump or a hand pump, connection devices for connecting the control device 1 to at least two tools, in particular a first lifting cylinder 2 and a second lifting cylinder 3 or the like, the changeover valve 5 being operable in particular by hand; wherein a) the changeover valve 5, when the operator lets go of it, can be brought automatically into a basic position in which no pressure build-up in the region of the tools is possible, b) a control valve 7 is provided between the changeover valve 5 and the tools, and c) the control valve 7 can likewise be operated by hand by an operator.

16 Claims, 1 Drawing Sheet

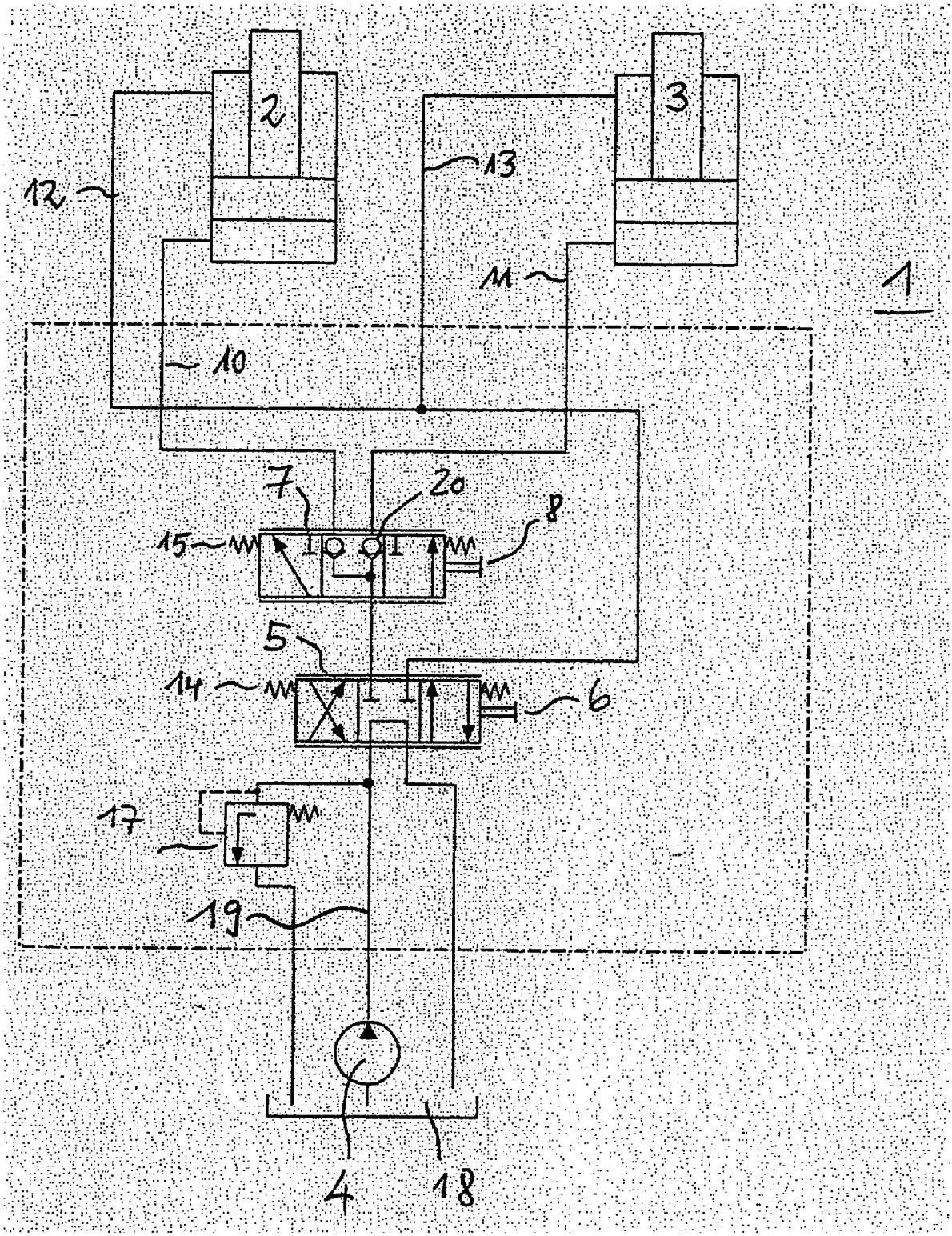
2
3
12
13
11
1
10
7
20
8
15
5
14
6
17
19
4
18

CONTROL DEVICE

The invention relates generally to control devices used in rescue technology. More specifically, the invention relates to control devices which maybe used to actuate cutters, spreaders, rescue cylinders and the like by means of a portable motor operated pump.

Such control devices are used in particular in rescue technology. They serve to actuate a plurality of tools, required for the rescue operation, by means of a pump, e.g. a portable motor-operated pump. This is because, during rescue operations, in particular loads (often several at the same time) also frequently have to be lifted for use of the tools, such as, for example, lifting cylinders, cutters, spreaders or rescue cylinders. The tools here are tools having a cylinder without a control system attached to the tool. For this reason, for example in everday use, it is certainly often the case that, in addition to one lifting cylinder, a further lifting cylinder is operated by one and the same pump.

The brochure LUKAS MSM-2D Mobil-Steuer-Module [mobile selection manifold] has disclosed a control system. In this case, the changeover valve, which can be actuated manually by means of a lever, latches in place in the respective operating position and remains in operation until the operator sets the changeover valve back into the passive position. If the operator is unable to continue working, the tools therefore continue to operate, thereby resulting in a possible dangerous situation.

The object of the present invention is to provide a novel control device with which the aforesaid problem is avoided. At the same time, the control device is to have a simple construction which can be implemented in a cost-effective manner.

In the case of the control device of the generic type, the present object is achieved in that a) the changeover valve, when the operator lets go of it, can be brought automatically into a basic position in which no pressure build-up in the region of the tools is possible,
b) a control valve is provided between the changeover valve and the tools, and
c) the control valve can likewise be operated by hand by an operator.

If the operator is unable to continue working and lets go of the changeover valve to be manually operated, a pressure in the tool (which pressure may already be built up by the preceding actuation) is maintained (load-holding function), but at the same time a further movement is prevented, by virtue of the fact that the basic position of the changeover valve occurs automatically. The movement of the tools is therefore interrupted immediately. The control device, including a "deadman function", can be operated with two hands by the operator, i.e. it is especially easy to operate. Nonetheless, however, the control device ensures increased operating safety. The changeover valve and/or control valve can be driven manually or by means of a drive and an operating element (e.g. pushbutton) to be operated by the operator.

Even in the case of the latter embodiment, the idea works out advantageously, since, for example in the event of a power failure in the system, a deadman function is obtained.

The outlet side of the control valve is expediently directly connected to the tools via operating-medium lines, so that the individual tools are activated directly by the control valve.

The control valve also expediently has means for automatically returning the control valve into a basic position when the operator lets go of the control valve. This is especially expedient when the current operating state of the respective tool is to be "frozen" in order to prevent danger on account of subsequent tool movements, such as, for example, lowering of the lifting cylinder, expanding of the spreader or the like, in the event of the operator being unable to continue working.

For this purpose, the basic position provided for the control valve is a position in which the operating medium located in the respective operating-medium line cannot flow off to the changeover valve, but at least cannot flow off to the changeover valve in substantial quantities. For example, this is made possible by each operating-medium line being operated against a non-return valve in the basic position of the control valve. The operating medium therefore cannot flow off, as a result of which a "load-holding state" is set.

The operating element provided at the control valve is expediently an operating lever.

The respective return line from the relevant tool, with the control valve being bypassed, runs in a common collecting duct directly to the changeover valve and from there, depending on the operating position, directly into the reservoir of the pump.

The basic position of the changeover valve is expediently a position in which an unpressurized circulation is effected via the pump. In this basic position, no pressure build-up in the region of the tools becomes possible, although the pump continues to run.

According to a further configuration of the present invention, the control valve is conceived in such a way that intermediate positions can be established by the operator via the manual actuation of the control valve like a joystick in such a way that the apportioning ratios of the feeding of operating medium to the individual tools can be correspondingly varied as a result.

This variation is preferably one in which unlimited intermediate positions are possible. This can be achieved though the use of a "proportional valve".

The control valve and/or changeover valve are/is expediently returned into the respective basic position by means of elastic preloading, for example through the use of a spring arrangement.

As in the control valve, an operating element, in particular in the form of a preselect lever, is also provided in the changeover valve.

The control device is provided as an independent handy unit which in each case is connected in use to the pump and the tools via corresponding operating-medium lines and return lines.

A relief valve is expediently located in the feed between the pump and the changeover valve, this relief valve connecting the pump to the reservoir. This relief valve serves to release the excess pressure arising in the basic position of the changeover valve to the reservoir of the pump.

According to the invention, the control device is provided in particular for a maximum operating pressure from 300 bar, preferably from 500 bar, preferably from 330 bar to 430 bar.

The operating medium provided is expediently hydraulic oil.

The tools are in particular those used in rescue and recovery technology, such as, for example, lifting cylinders and other tools which have no separate control device on the appliance.

The present invention is explained in more detail with reference to a simplified schematic diagram.

FIG. 1 is a circuit diagram of a control device according to the present invention.

Reference numeral 1 identifies the portable control device according to the invention, i.e. the control device which can be handled independently, the components of which are arranged inside the chain-dotted area. The control device 1 is connected to a pump 4 and to a plurality of tools (e.g. hydraulically driven), two tools in the case of the drawing FIGURE. These tools are, for example, a first lifting cylinder 2 and a second lifting cylinder 3 which are to be operated simultaneously by the single pump 4. In this practical case of a configuration of the invention, the two lifting cylinders 2, 3 work in the same direction. The pump 4 is a motor-driven pump or a hand pump. The operating pressure is around 350 bar for example.

The control device 1 serves to enable the operator to coordinate the operation of the two tools using a single pump 4 if and when required.

To this end, the control device 1 comprises a changeover valve 5, with which three operating positions can be realized in the example in the drawing FIGURE, namely crossover position (retraction of the tools into the initial position), basic position (no operation of the tools) and parallel position (operation of the tools). In the state of the basic position, the operating medium (in particular hydraulic oil) delivered by the pump 4 is delivered back directly into the return line to the reservoir 18. The relief valve 17 serves for relieving the load if excess pressure possibly builds up.

The respective changeover position of the changeover valve 5 is selected via a preselect lever 6 which the operator can actuate manually. The changeover valve 5 is conceived in such a way that, when the operator lets go of the preselect lever 6, said changeover valve 5, due to a spring arrangement 14, shifts automatically into the basic position, which is shown centrally in the single FIGURE and in which only an unpressurized circulation of the operating medium takes place. If the operator therefore lets go of the preselect lever 6 of the changeover valve 5, no delivery of the operating medium from the changeover valve to the tools is effected due to the changeover valve 5 being returned into the basic position.

In order to automatically establish the basic position, elastic preloading, for example in the form of the aforesaid spring arrangement 14, may be provided.

Furthermore, the control unit 1 according to the invention comprises an additional control module, in particular a control valve 7, which is provided between the changeover valve 5 and the tools. The pressure-medium line between changeover valve 5 and the individual tools consequently runs via the control valve 7.

The control valve 7 can also be operated manually in its position, expediently likewise by an operating element 8, e.g. an operating lever. The control valve 7 likewise has an automatic function for return into a basic position (centre position in the drawing FIGURE) when the operator lets go of the operating lever, in which basic position the two operating-medium lines 10, 11 of the tools can each be operated against a non-return valve 20. In this way, since operating medium does not flow off to the changeover valve 5, a load-holding state can be set at the tools. There is therefore no change in the respective current position of the first lifting cylinder 2 and of the second lifting cylinder 3.

In order to automatically establish the basic position of the control valve 7, elastic preloading, for example in the form of a spring arrangement 15, may likewise be provided.

The control valve 7 is designed as a "proportional valve", as a result of which the operator, via the operating element 8, can manually apportion the volumetric flows, to be distributed via the control valve, from the pump 4 to the individual tools in any desired manner and thus can activate the individual tools individually. The operator can operate the control valve 7 using one hand like a joystick control, in the course of which he establishes the function of the changeover valve 5 using the other hand.

Thus, with reference to the single drawing FIGURE, if the arrangement consisting of first lifting cylinder 2 and second lifting cylinder 3 is operated by a single operator by means of the control device 1, and if this operator is unable to continue working (for example due to fainting), the operating elements 6 and 8 are let go of, whereupon the changeover valve 5 and the control valve 7 move into their respective basic positions—as shown in the drawing FIGURE. The basic position of the changeover valve 5 causes operating medium to be delivered in an unpressurized circulation by the pump. At the same time, the basic position of the control valve 7 ensures that the tools, i.e. the first lifting cylinder 2 and the second lifting cylinder 3, do not move in their current position on account of the load-holding position.

Instead of two tools, a larger number of tools may just as easily be provided. Due to the concept, the changeover valve 5 may advantageously be a conventional changeover valve which can be used without design changes. The control valve 7 and/or the changeover valve 5 may be driven manually or in a motor-operated manner. The pump used may be a pump having a plurality of operating-medium circuits independent of one another, thus, for example, a "double-flow pump". In the latter case, two lifting cylinders and rescue cutters could be operated in parallel by the control unit according to the invention.

The present invention ensures the simultaneous operation of a plurality of tools with the use of a pump, having considerable ease of operation for the operator, a reliable "deadman function" and a simple construction which can be realized in a favourable manner from the cost point of view. The invention therefore represents a special contribution to the relevant prior art.

LIST OF DESIGNATIONS

1 Control device
2 First lifting cylinder
3 Second lifting cylinder
4 Pump
5 Changeover valve
6 Operating element
7 Control valve
8 Operating element
9 Operating element
10 Operating-medium line
11 Operating-medium line
12 Return line
13 Return line
14 Spring arrangement
15 Spring arrangement
16 Reservoir
17 Relief valve
18 Reservoir
19 Feed
20 Non-return valve

The invention claimed is:

1. A control device having
a changeover valve,
a pump delivering operating medium, in particular a motor-operated pump or a hand pump,
connection devices for connecting the control device to at least two tools, in particular a first lifting cylinder and a second lifting cylinder, the changeover valve being operable in particular by hand, wherein a) the changeover valve, when the operator lets go of it, can be brought automatically into a basic position in which no pressure build-up in the region of the tools is possible, b) a control valve is provided between the changeover valve and the tools, and the control valve has a basic position in which the operating medium located in the respective operating-medium line cannot flow off to the changeover valve or cannot flow off to the changeover valve in substantial quantities, c) the control valve (7) comprises a proportional valve and can be operated manually, d) a load-holding state is set in the basic position of the changeover valve as well as of the control valve, and e) two or more tools are controllable with the control valve.

2. The control device of claim 1 wherein the control valve has means for automatically returning the control valve into a basic position when the operator lets go of the control valve.

3. The control device of claim 1, wherein each operating-medium line is operated against a non-return valve in the basic position of the control valve.

4. The control device of claim 1, wherein the control valve has an operating element.

5. The control device of claim 4, wherein said operating element comprises an operating lever.

6. The control device of claim 1, wherein the respective return line of the tools runs directly to the changeover valve.

7. The control device of claim 1, wherein the basic position of the changeover valve is a position in which an unpressurized circulation is effected via the pump.

8. The control device of claim 1, wherein intermediate positions, in particular unlimited intermediate positions, can be established manually by means of the operating element of the control valve.

9. The control device of claim 1, wherein the means provided for returning the control valve into the basic position ins a spring arrangement.

10. The control device of claim 1 wherein an operating element, in particular a preselect lever, is provided for actuating the changeover valve.

11. The control device of claim 1, wherein the control device is provided as an independent unit which is connected to the pump and the tools in each case via the operating-medium lines and return lines.

12. The control device of claim 1, wherein a relief valve is connected in the feed between pump and changeover valve, this relief valve being connected to the reservoir of the pump.

13. The control device of claim 1, wherein the control device is provided for a maximum operating pressures from 300 bar, to 500 bar.

14. The control device of claim 13, wherein the control device is provided for a maximum operating pressure of from 330 bar to 430 bar.

15. The control device of claim 1, wherein the operating medium provided is hydraulic oil.

16. The control device of claim 1, wherein the tool in question concerns tools used in rescue technology.

* * * * *

UNITED STATES PATENT AND TRADEMARK OFFICE

CERTIFICATE OF CORRECTION

PATENT NO. : 7,409,828 B2
APPLICATION NO. : 11/251098
DATED : August 12, 2008
INVENTOR(S) : Wolfgang Bertleff It is certified that error appears in the above-identified patent and that said Letters Patent is hereby corrected as shown below:

1) Col. 6, line 6, Claim 9; delete “ins” and replace with “is”.

2) Col. 6, line 19, Claim 13; delete the final “s” from “pressures” to make singular.

Signed and Sealed this

Twenty-sixth Day of May, 2009

John Doll

JOHN DOLL
*Acting Director of the United States Patent and Trademark Office*